United States Patent [19]

Hattori et al.

[11] 4,077,207

[45] Mar. 7, 1978

[54] ADDITIONAL AIR CONTROL DEVICE FOR MAINTAINING CONSTANT AIR-FUEL RATIO

[75] Inventors: Tadashi Hattori, Okazaki; Takamichi Nakase, Gamagori; Hiroaki Yamaguchi, Nukata, all of Japan

[73] Assignee: Nippon Soken, Inc., Nishio, Japan

[21] Appl. No.: 740,174

[22] Filed: Nov. 9, 1976

[30] Foreign Application Priority Data

Nov. 11, 1975 Japan ..... 50-135396

[51] Int. Cl.[2] ..... F02B 75/10

[52] U.S. Cl. ..... 60/276; 123/119 D; 123/119 EC; 123/119 VC; 123/124 B

[58] Field of Search ..... 123/119 D, 119 EC, 32 EE, 123/119 VC, 119 E, 32 EL, 124 R, 124 A, 124 B; 60/276, 285

[56] References Cited

U.S. PATENT DOCUMENTS

| | | | |
|---|---|---|---|
| 3,745,768 | 7/1973 | Zechnall et al. | 123/32 EE |
| 3,759,232 | 8/1973 | Wahl | 123/119 D |
| 3,815,501 | 6/1974 | Seitz | 123/32 EE |
| 3,827,237 | 8/1974 | Linder et al. | 173/119 EC |
| 3,960,118 | 6/1976 | Konomi et al. | 123/32 EE |
| 3,973,529 | 8/1976 | Wessel et al. | 123/32 EE |
| 4,019,470 | 4/1977 | Asano | 123/32 EE |
| 4,020,813 | 5/1977 | Hattori et al. | 123/124 B |
| 4,029,061 | 6/1977 | Asano | 123/32 EE |
| 4,031,866 | 6/1977 | Asano | 123/32 EE |

*Primary Examiner*—Wendell E. Burns

*Attorney, Agent, or Firm*—Cushman, Darby & Cushman

[57] ABSTRACT

An additional air control device for maintaining constant air-fuel ratio in an internal combustion engine wherein an intake air which is supplied additionally through a bypass passage to the engine is controlled by controlling the movement of a drive motor coupled to a control valve mounted in the bypass passage. A gas sensor for sensing the oxygen content of the exhaust gas and an intake air flow meter for sensing the rate of intake air flow to the engine are provided. In accordance with a signal from the gas sensor and an intake air flow signal representing a delay time factor from the intake air flow sensor, the drive motor is controlled to stop or drive alternately in a skip movement fashion in either an opening or closing direction of the control valve, and a rest period of the drive motor is determined to be inversely proportional to the intake air flow rate and a driving period which is subsequent to the rest period is set to a fixed time period, thereby an air-fuel ratio is maintained at a constant value and an exhaust gas emission is controlled.

5 Claims, 9 Drawing Figures

ADDITIONAL AIR CONTROL DEVICE FOR MAINTAINING CONSTANT AIR-FUEL RATIO

The present invention relates to additional air control devices and more particularly to an additional air control device which is capable of suitably compensating the air-fuel ratio of the mixture.

To obtain the maximum of efficiency of the modified internal combustion engines heretofore proposed for automotive exhaust emission control purposes or to ensure the optimum exhaust gas purifying efficiency of the catalyst mounted in engines for exhaust emission control purposes, the air-fuel ratio of the mixture supplied to the engine must always be controlled properly or the amount of secondary air supplied into the catalystic converter must be controlled properly.

In a control device of the above type heretofore proposed, for example, in U.S. Pat. No. 3,827,237 issued Aug. 6, 1974, the oxygen content of the exhaust gases, for example, is sensed by a gas sensor to detect the air-fuel ratio of the mixture and a control valve is operated in response to the output signal of the gas sensor to continuously control the amount of additional correcting air to gradually decrease or increase it, thus accomplishing feedback control of the air-fuel ratio of the mixture.

In this type of control device, generally a motor is employed for operating the control valve and the time rate of change of the controlled air-fuel ratio is dependent on the rate of change of the passage area for the additional air flow which is controlled by the motor. Consequently, the control of air-fuel ratio is accomplished by presetting the motor driving speed to the optimum speed so that the control range of air-fuel ratio is minimized under the steady-state conditions as well as the transient conditions.

However, the conventional control device of this type is disadvantageous in that since the device employs an integral control system which controls the air-fuel ratio continuously and moreover the effects of other factors are not practically taken into consideration, even if the driving speed is preset to the optimum value as mentioned previously, due to the fixed driving speed, the air-fuel ratio is varied considerably under the effect of a factor, e.g., a delay time between the occurrence of a change of the air-fuel ratio in the intake system and the time that the gas sensor senses the change in the exhaust system, thus failing to ensure satisfactory control of the air-fuel ratio.

Particularly, the light load, low rotational speed range where the amount of intake air is small, the delay time is increased causing a hunting phenomenon and thereby failing to ensure full display of the cleaning ability of the catalyst and moreover a surging phenomenon is caused during running of the vehicle with the resulting deterioration of its drivability. Thus, there is much room for improvements on this type of control device.

With a view to overcoming the foregoing difficulty, it is an object of the present invention to provide an additional air control device wherein the running and stopping of drive means are alternately and intermittently controlled in a skip fashion by control means to satisfactorily control the amount of additional air supply under the steady-state conditions as well as the transient conditions so that as for example, the control range of the air-fuel ratio is always maintained small and thus the air-fuel ratio of mixture is maintained constant.

It is another object of this invention to provide an additional air control device wherein one of the driving and rest time periods of a control valve is controlled in accordance with a delay time factor (e.g., the amount of intake air, engine rotational speed, intake manifold vacuum, venturi vacuum or the like) and the other is fixed, whereby with a simple construction, any inconvenience due to the delay time factor is eliminated and more satisfactory control of the additional air flow is ensured, thus ensuring full display of the ability of the catalyst and eliminating the occurrence of any surging phenomenon in the light load, low speed range of the engine to ensure an improved drivability.

The device of the invention has among its advantages the fact that one of the running time and stopping time of a pulse motor is varied in accordance with delay time factor and the other is fixed, thus simplifying the construction of control means.

These and other object, features and advantages of this invention will become readily apparent from the following detailed description taken in conjunction with the accompanying drawings, in which.

The present invention will now be described in greater detail with reference to the illustrated embodiment.

Figure 1:
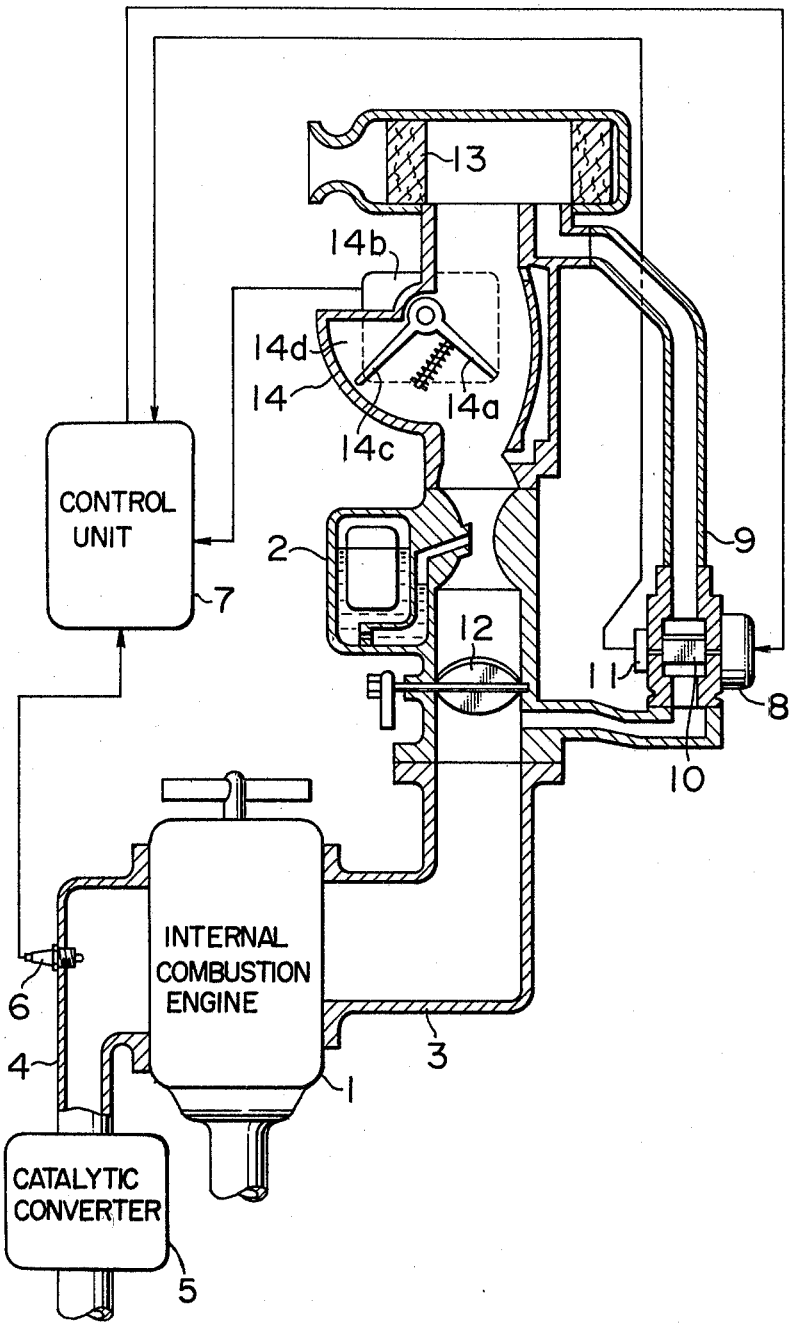
FIG. 1 is a schematic diagram showing the overall construction of an embodiment of this invention.

Referring to FIG. 1 illustrating the overall system of the invention, an internal combustion engine 1 is the conventional spark-ignition, four-cycle engine and air-fuel mixture is supplied to the engine 1 by a carburetor 2 through an intake manifold 3. The carburetor 2 having a main passage, is of the conventional type and it has been set to produce an air-fuel mixture which is slightly rich as compared with the desired air-fuel ratio demanded by the engine 1.

Figure 8:
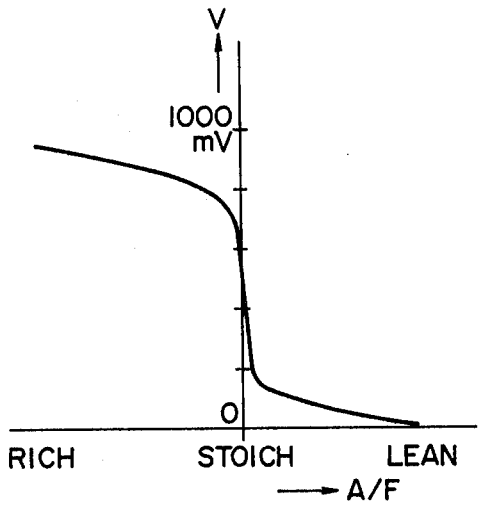
FIG. 8 is an output characteristic diagram of the gas sensor shown in FIG. 1.

Disposed in the exhaust system of the engine 1 are an exhaust manifold 4 and a three-way catalytic converter 5 and also mounted in the exhaust manifold 4 is a gas sensor 6 which senses by a metal oxide such as zirconium dioxide or titanium dioxide the content of oxygen, a constituent, of the exhaust gases. Where the gas sensor 6 employs zirconium dioxide, for example, as shown in FIG. 8, the gas sensor 6 comes into operation at around the stoichiometric air-fuel ratio so that when the detected air-fuel ratio is rich (small) as compared with the stoichiometric one, it produces an electromotive force between 80 and 100 mV, whereas when the detected air-fuel ratio is lean (large) as compared with the stoichiometric one, the resulting electromotive force is of the order of 10 to 0 mV. An electronic control unit 7 is responsive to the signals from the gas sensor 6, etc., to drive a four-phase pulse motor 8 in a selected direction. The pulse motor 8 operates a control valve 10 mounted in an additional air passage or a bypass passage 9 to open and close and the drive shaft of the pulse motor 8 is connected to the control valve 10. The control valve 10 is a known butterfly valve and there is provided a valve-fully-closed switch 11 so that when the control valve 10 is in its fully closed position, this is detected and a full closed position signal is produced and applied to the control unit 7.

A throttle valve 12 is mounted in the downstream portion of the carburetor 2 and the upstream portion of the carburetor 2 includes an air cleaner 13 and an air flow meter 14 constituting delay time detecting means. The additional air passage 9 is disposed to communicate the air cleaner 13 with the downstream side of the throttle valve 12.

The air flow meter 14 directly measures the mass air flow through the intake pipe by a rotatably mounted measuring flap 14*a* and the amount of movement of the flap 14*a* is converted into an electric signal by a potentiometer 14*b* thus detecting the amount of intake air. The output terminal of the potentiometer 14*b* is electrically connected to the control unit 7.

Figure 6:
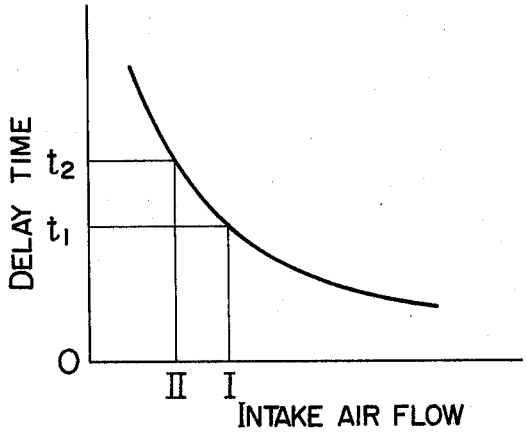
FIG. 6 is a characteristic diagram showing the relationship between the amount of intake air and the delay time.

In this case, as shown in FIG. 6, the amount of intake air flow is in a function relationship with respect to the delay time corresponding to a time period between the occurrence of a change in the air-fuel ratio and the detection in the exhaust gas system by the gas sensor, and thus the amount of intake air flow constitutes a delay time factor corresponding to the delay time.

Figure 2:
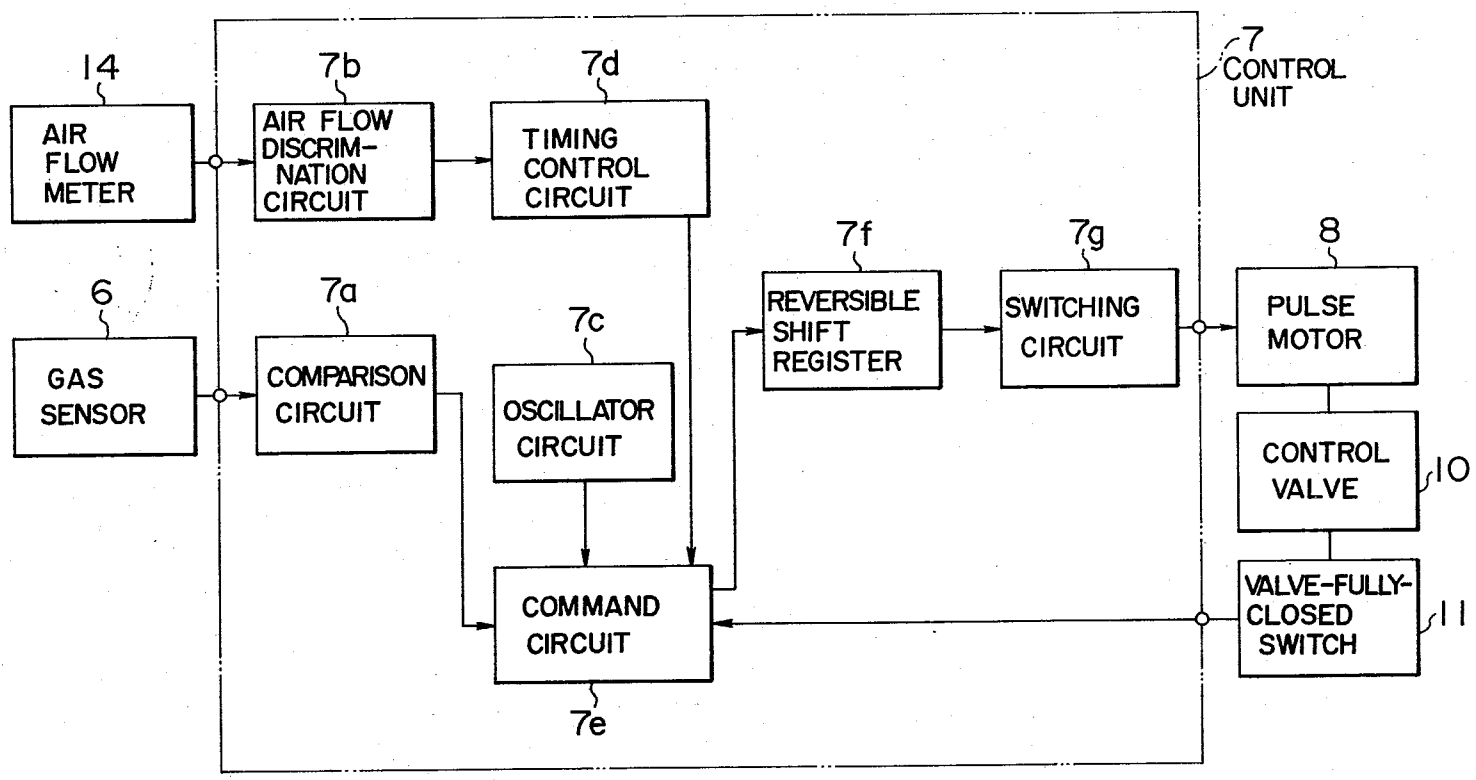
FIG. 2 is a block diagram of the electronic control unit shown in FIG. 1.

Next, the control unit 7 will be described with reference to the block diagram shown in FIG. 2. The control unit 7 receives as its input signals the output signal of the gas sensor 6, the output signal of the air flow meter 14 for measuring the amount of intake air corresponding to the delay time factor and the output signal of the valve-fully-closed switch 11, and the control unit 7 comprises a comparison circuit 7*a*, an air flow discrimination circuit 7*b*, an oscillator circuit 7*c*, a timing control circuit 7*d*, a command circuit 7*e*, a reversible shift register 7*f* and a switching circuit 7*g*, thereby operating the pulse motor 8 in accordance with the input signals.

With this construction, basically the air-fuel mixture produced in the carburetor 2 is burned in the combustion chambers of the engine 1 and thereafter any change in the air-fuel ratio is detected in the exhaust system by the gas sensor 6 whose output signal is in turn applied to the comparison circuit 7*a* where the air-fuel ratio is determined whether it is rich or lean as compared with the present air-fuel ratio to be controlled (the stoichiometric air-fuel ratio in this embodiment), so that when the air-fuel ratio is rich, the pulse motor 8 operates the control valve 10 mounted in the additional air passage 9 in a direction which opens it, whereas when the air-fuel ratio is lean the conrol valve 10 is operated in a direction which closes it, thus compensating the air-fuel ratio to attain the preset air-fuel ratio by means of the additional air supplied to the downstream side of the throttle valve 12.

In this case, the timing control circuit 7*d* determines the running and stopping times of the pulse motor 8 in response to the signal from the air flow meter 14, so that the running and stopping of the pulse motor 8 are alternately and intermittently controlled in a skip fashion through the command circuit 7*e*, the reversible shift register 7*f* and the switching circuit 7*g* and the control range of the air-fuel ratio is reduced to attain the preset air-fuel ratio.

Figure 3:
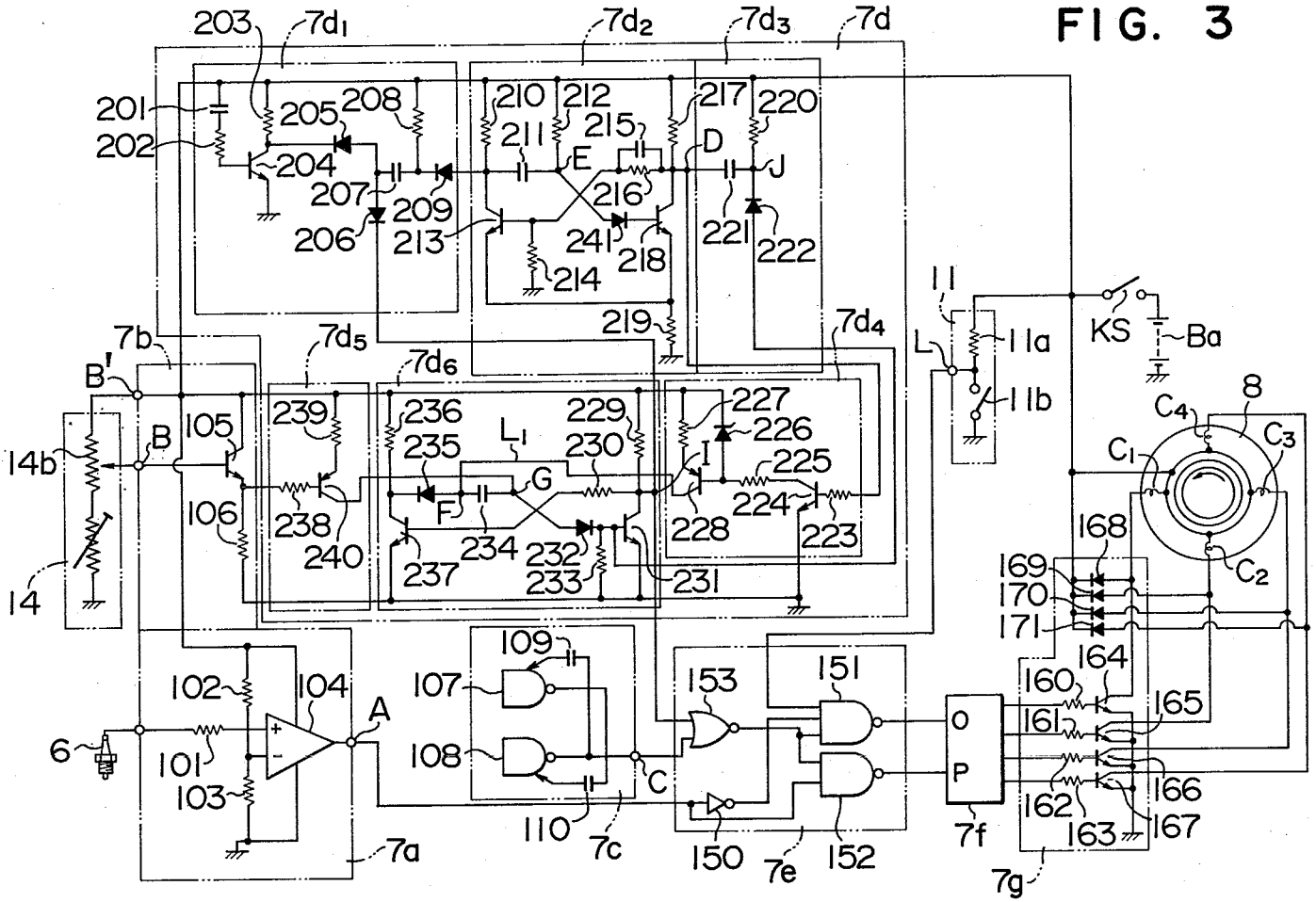
FIG. 3 is a circuit diagram of the electronic control unit shown in FIG. 1.

The control unit 7 will now be described in greater detail with reference to FIGS. 3 and 7. The comparison circuit 7*a* comprises an input resistor 101, voltage dividing resistors 102 and 103, and a differential operational amplifier (OP AMP) 104, and the OP AMP 104 has its converting input terminal connected to the gas sensor 6 through the input resistor 101 and its inverting terminal to the voltage dividing point of the dividing resistors 102 and 103. Thus, the comparison circuit 7*a* compares its input voltage with a preset voltage preset by the voltage dividing resistors 102 and 103 (i.e., the voltage practically equal to the electromotive force produced by the gas sensor 6 at the stoichiometric air-fuel ratio), so that a "1" level signal is produced at its output terminal A when the input voltage is higher than the preset voltage or richer than the stoichiometric one, whereas a "0" level signal is produced at the output terminal A when it is lower than the preset voltage or leaner than the stoichiometric one.

The air flow discrimination circuit 7*b* comprises an emitter-follower circuit including a transistor 105 and an emitter resistor 106 and the base of the transistor 105 is connected to a variable terminal B of the potentiometer 14*b* of the air flow meter 14. Thus, the potential difference between the variable terminal B and a fixed terminal B' which is inversely proportional to the amount of intake air, is detected and applied to the timing control circuit 7*d*.

The oscillator circuit 7*c* comprises an astable multivibrator including NAND gates 107 and 108 with expander terminals and capacitors 109 and 110 and it produces pulses for driving the pulse motor 8. The frequency of these driving pulses is set to the optimum value so that the control range of air-fuel ratio is reduced under the transient conditions in order to skip drive the pulse motor 8 and the output waveform produced at an output terminal C of the oscillator circuit 7*c* consists of pulses having a duty cycle of 1 : 1 as shown at (*a*) and (*b*) of FIGS. 5A and 5B.

Figure 4:
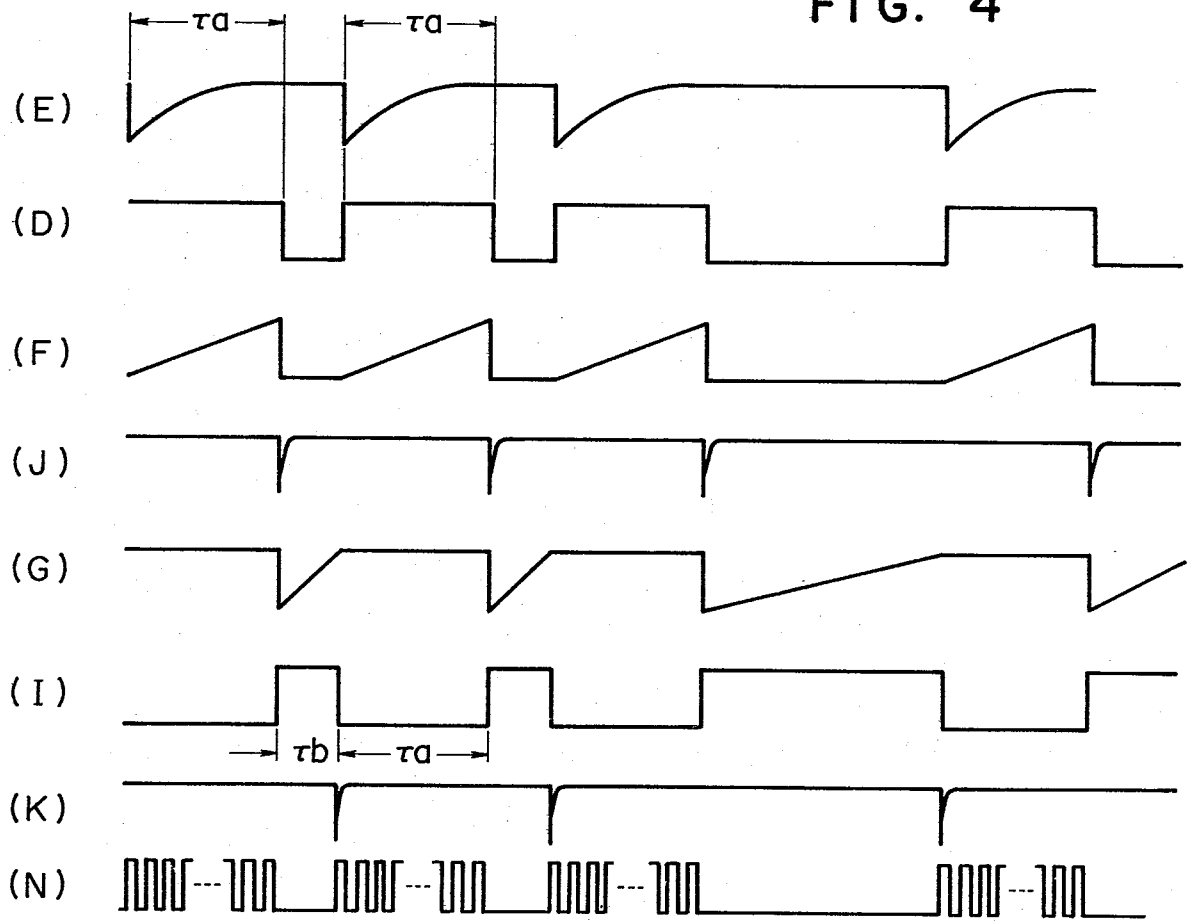
FIG. 4 is a waveform diagram useful for exaplaining the operation of the electronic control unit.

The timing control circuit 7*d* comprises a first trigger circuit $7d_1$ including capacitors 201 and 207, resistors 202, 203 and 208, diodes 205, 206 and 209 and a transistor 204, a first monostable circuit $7d_2$ including resistors 210, 212, 214, 216, 217 and 219, capacitors 211 and 215, transistors 213 and 218 and a diode 241, a second trigger circuit $7d_3$ including a resistor 220, a capacitor 221 and a diode 222, a charging circuit $7d_4$ including resistors 223, 225 and 227, a Zener diode 226 and transistors 224 and 228, a discharging circuit $7d_5$ including resistors 238 and 239 and a transistor 240, and a second monostable circuit $7d_6$ including resistors 229, 230, 233 and 236, a capacitor 234, diodes 232 and 235 and transistors 231 and 237, and the timing control circuit 7*d* is responsive to the signal from the air flow discrimination circuit 7*b* to produce a pulse signal whose pulse width $\tau_a$ varies in accordance with the amount of intake air as shown in (I) of FIG. 4.

When a key switch KS is turned on so that a D.C. power source B*a* is connected, just after the connection of the power source B*a* the transistor 204 of the first trigger circuit $7d_1$ is turned on and its collector voltage decreases to about 0 V. Consequently, the base potential of the transistor 218 of the first monostable circuit $7d_2$ is decreased with the result that the transistor 218 is turned off and this off-condition is maintained for the duration of a time which is determined by the capacitor 211 and the resistor 212, namely, during the time $\tau_a$ in (E) of FIG. 4 showing the voltage waveform at a terminal E. Thus, the output signal of the first monostable circuit $7d_2$ which is delivered from the collector of the transistor 218, goes to the "1" level for the duration of the said determined time and this "1" level signal turns on both of the transistors 224 and 228 of the charging circuit $7d_4$. Consequently, a constant current which is determined by the Zener diode 226 flows from the charging circuit $7d_4$ into second monostable circuit $7d_6$ through a conductor $L_1$ for a determined time period. Thus, in the second monostable circuit $7d_6$, the capacitor 234 is charged by this constant current and the resulting charge voltage at its terminal F rises as shown in (F) of FIG. 4. During this time interval, the discharging circuit $7d_5$ supplies to the second monostable circuit $7d_6$ a current which is determined by the potentiometer 14*b* of the air flow meter 14 and which is inversely proportional to the amount of intake air and thus the transistor 231 is turned on through the diode 232 of the second monostable circuit $7d_6$. When the determined time expires so that the transistor 204 of the first trigger circuit $7d_1$ is turned off and the transistor 218 of the first monostable circuit $7d_2$ is turned on, the output pulse of the first monostable circuit $7d_2$ goes to the "0" level as shown in (D) of FIG. 4 so that instantly the transistors 224 and 228 of the charging circuit $7d_4$ are turned off and the charging of the capacitor 234 is terminated.

Simultaneously, the second trigger circuit $7d_3$ produces at its terminal J a negative trigger signal as shown in (J) of FIG. 4 thus turning off the transistor 231 through the diode 222. When this occurs, the output of the timing control circuit *7d* at its output terminal I which is delivered from the collector of the transistor 231, goes from the "0" to "1" level.

When the output of the transistor 231 changes its state, the transistor 237 is turned on and the potential across the capacitor 234 is decreased rapidly. Thus, the charge stored in the capacitor 234 is discharged and dissipated by the discharge current corresponding to the amount of intake air and thereafter the discharge potential at a terminal G of the capacitor 234 rises as shown in (G) of FIG. 4, thus again turning the transistor 231 on and thereby causing the output of the timing control circuit *7d* to go from the "1" to "0" level.

With the transistor 231 turned on again, its collector voltage again becomes about 0 V with the result that the transistor 218 of the first monostable circuit $7d_2$ is again turned off through the diode 206, etc., and thereafter the above-mentioned operation is repeated.

Thus, during the time that the transistor 231 is turned off, the output of the timing control circuit *7d* is held at the "1" level thus producing a stop pulse signal having a pulse width $\tau_b$ as shown in (I) of FIG. 4 and this stop pulse width $\tau_b$ is proportional to the amount of intake air as mentioned previously.

The valve-fully-closed switch 11 comprises a resistor 11*a* and a switch 11*b*, so that when the control valve 10 is brought into its fully closed position, the switch 11*b* is closed and the output at its output terminal L goes to the "0" level.

The output signals of the comparison circuit *7a*, the oscillator circuit *7c*, the timing control circuit *7d* and the valve-fully-closed switch 11 are applied to the command circuit *7e* thus producing forward, reverse and stop signals for the pulse motor 8.

The command circuit *7e* comprises an inverter 150, NAND gates 151 and 152 and a NOR gate 153 and constitutes a control logic for the pulse motor 8.

Figure 5A:
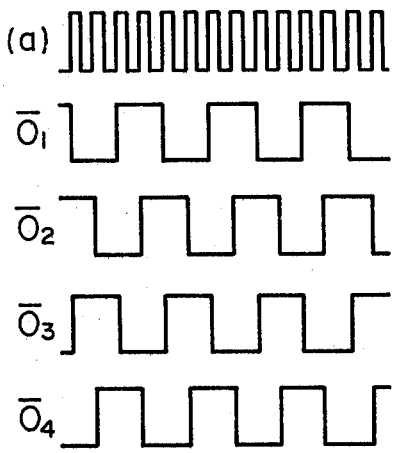
FIGS. 5A and 5B are waveform diagrams useful for explaining the operation of the reversible shift register shown in FIG. 3.
Figure 5B:
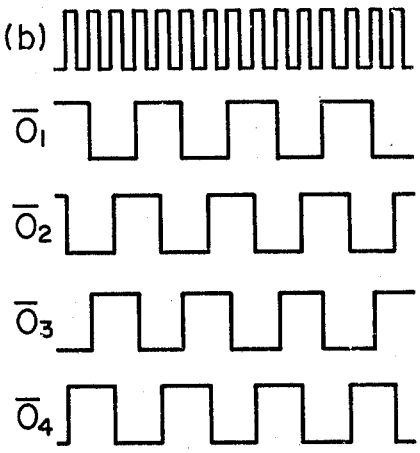

The pulse motor driving pulse signals produced from the oscillator circuit *7c* and shown in FIGS. 5A and 5B are applied to the NOR gate 153 of the command circuit *7e* and the NOR gate 153 also receives the output pulse signal of the timing control circuit *7d* shown in (I) of FIG. 4 and having the pulse width $\tau_b$ which is varied in accordance with the signal from the air flow meter 14 ($\tau_a$ is fixed). Consequently, only during the time that the pulse signal from the timing control circuit *7d* is at the "0" level (namely, during the time $\tau_a$), the NOR gate 153 produces as its output the pulse motor driving pulse signals from the oscillator circuit *7c* and applies the pulses to the NAND gates 151 and 152, respectively.

The NAND gate 151 has three input terminals which receive respectively the signals from the NOR gate 153, the signal from the valve-fully-closed switch 11 and the signal from the comparison circuit *7a* through the inverter 150. The NAND gate 152 has two input terminals so that the signal from the comparison circuit *7a* is directly applied to the NAND gate 152 in addition to the pulse signals from the NOR gate 153.

Thus, only when the output of the valve-fully-closed switch 11 is at the "1" level so that the control valve 10 is not in the fully closed position and the output of the comparison circuit *7a* is at the "0" level indicating that the air-fuel ratio of mixture is large (lean), the pulse signals from the NOR gate 153 are inverted and delivered as the output of the NAND gate 151 and these pulse signals are intermittently applied to an input terminal 0 of the reversible shift register *7f* as shown in (N) of FIG. 4.

On the other hand, only when the output of the comparison circuit *7a* goes to the "1" level and the air-fuel ratio of mixture is small (rich), the pulse signals from the NOR gate 153 are inverted and delivered as the output of the NAND gate 152 and these pulses are intermittently applied to an inut terminal P of the reversible shift register *7f* as shown in (N) of FIG. 4. In the reversible shift register *7f* which receives as its input signals the output of the NAND gates 151 and 152, respectively, its output terminals $\overline{O}_1$, $\overline{O}_2$, $\overline{O}_3$ and $\overline{O}_4$ are sequentially shifted as shown in FIG. 5A when the pulse signals are applied to the input terminal P. On the contrary, when the pulse signals are applied to the input terminal O, the ouput terminals $\overline{O}_4$, $\overline{O}_3$, $\overline{O}_2$ and $\overline{O}_1$ are sequentially shifted in this order as shown in FIG. 5B. The output terminals $\overline{O}_1$, $\overline{O}_2$, $\overline{O}_3$ and $\overline{O}_4$ are all connected to the switching circuit *7g* comprising resistors 160, 161, 162 and 163, transistors 164, 165, 166 and 167 and back electromotive force absorbing diodes 168, 169, 170 and 171, and the switching circuit *7g* is in turn connected to field coils $C_1$, $C_2$, $C_3$ and $C_4$ of the pulse motor 8. Thus, when the pulse signals are applied to the input terminal P of the reversible shift register *7f*, the transistors 164, 165, 166 and 167 are sequentially turned on and the field coils $C_1$, $C_2$, $C_3$ and $C_4$ of the four-phase pulse motor 8 are similarly energized two phases at a time, thus rotating the rotor of the pulse motor 8 in the direction of the arrow in FIG. 3 and thereby rotating the control valve 10 in a direction which opens it. On the contrary, when the pulse signals are applied to the input terminal O, the rotor of the pulse motor 8 is rotated in a direction opposite to the direction of the arrow in the Figure and the control vlave 10 is rotated in a direction which closes it.

Thus, by utilizing the predetermined time period $\tau_a$ as its running time and as its stopping time the time period $\tau_b$ which is varied in response to the signal produced from the air flow meter 14, the running and stopping of the pulse motor 8 are effected intermittently and this operation is repeatedly performed, thereby adjusting the additional air flow in accordance with the amount of intake air which is the delay time factor of the system.

Generally, there is an inversely proportional relationship between the amount of intake air and the system delay time as shown by the curve of FIG. 6 and this relationship will now be described with reference to FIG. 7 assuming that a delay time $t_1$ corresponds to an intake air flow I and a delay time $t_2$ corresponds to an intake air flow II.

Figure 7:
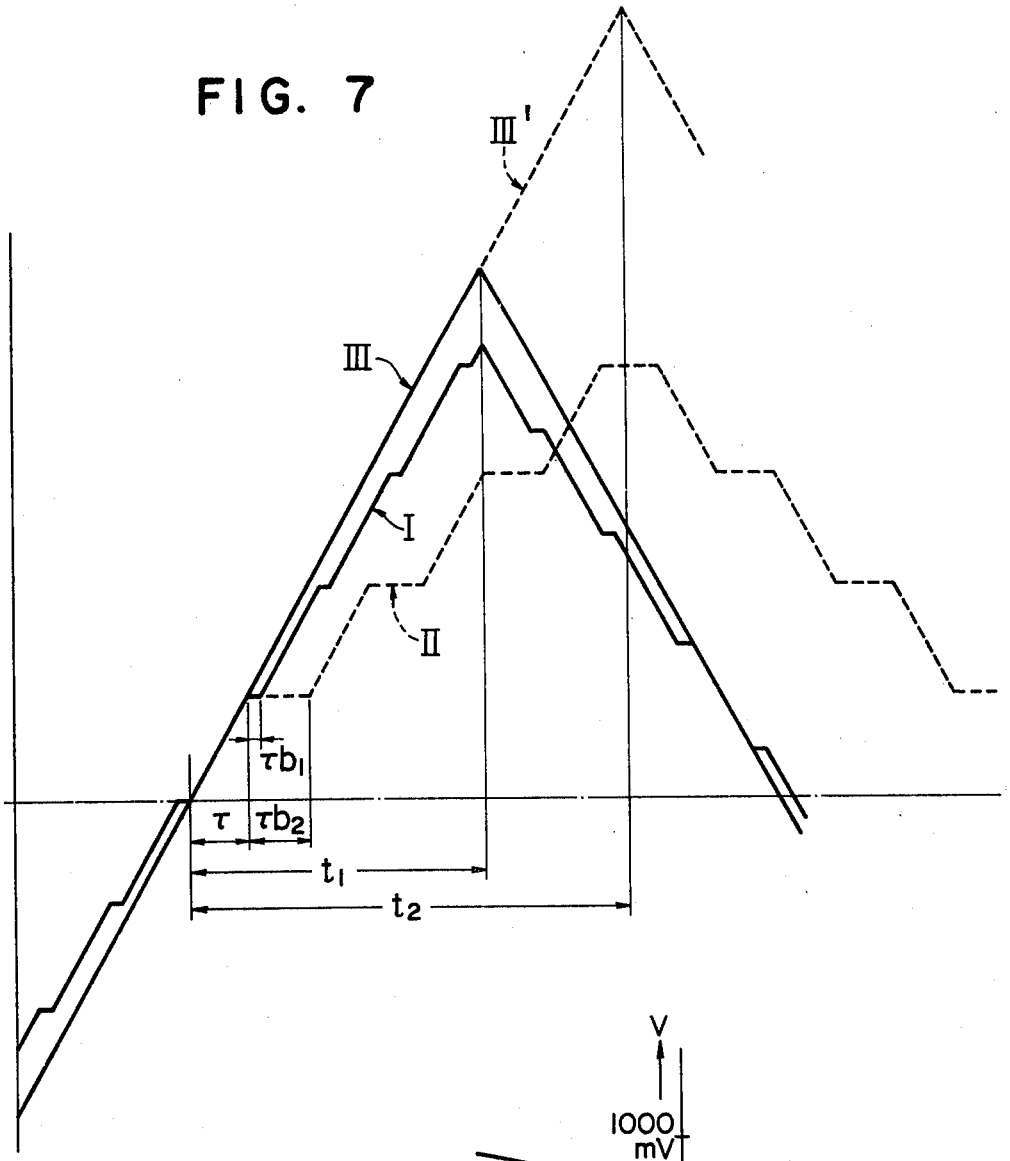
FIG. 7 is a characteristic diagram useful for explaining the operation of the embodiment shown in FIG. 1.

In the Figure, where the pulse motor driving frequency is fixed in the conventional device employing a continuous control system, if, for example, the air-fuel ratio of the mixture in the intake manifold 3 becomes greater than the preset air-fuel ratio (in this embodiment, the stoichiometric air-fuel ratio with the excess air factor $\lambda$ of 1) and the mixture becomes lean, during the delay time $t_1$ or $t_2$, the gas sensor 6 cannot detect in the exhaust manifold 4 the fact that the air-fuel ratio of the mixture has exceeded the preset air-fuel ratio and the amount of additional air is increased continuously as shown by the broken lines III and III' in FIG. 7, thus varying the air-fuel ratio considerably and increasing the control range of air-fuel ratio and thereby retarding the adjustment of the air-fuel ratio of mixture to the preset air-fuel ratio. Particularly, in the case of the smaller intake air amount II, the system delay time $t_2$ is increased correspondingly so that the amount of additional air is controlled as shown by the straight line III' and thus the air-fuel ratio is varied to a greater extent.

On the contrary, with the control device of this invention, the pulse motor 8 is operated only during the predetermined time $\tau_a$ and stopped only during the time $\tau_b$ and this operation is repeatedly performed with the result that the amount of additional air is intermittently increased as shown by the broken line I or II in FIG. 7 and the additional air is supplied to the intake manifold 3 through the control valve 10. Consequently, the control range of the air-fuel ratio of mixture is maintained small.

Further, with the control device of this invention, where the amount of intake air is increased as shown at I in FIG. 6 during the period of acceleration of the engine 1, for example, the stopping time $\tau_b$ of the pulse motor 8 is reduced to $\tau_{b1}$ in inverse proportion to the amount of intake air in order to be driven in a skip movement fashion with the result that the control speed as a whole is also increased as shown by the broken line I in FIG. 7 and the air-fuel ratio of mixture is rapidly adjusted to the preset air-fuel ratio. On the other hand, where the amount of intake air is relatively small as shown at II in FIG. 6 during the steady-state operation, for example, the stopping time $\tau_b$ is increased to $\tau_{b2}$ as shown by the broken line II in FIG. 7 in inverse proportion to the amount of intake air with the result that the system delay time is increased to $t_2$ and although the pulse motor is driven in a skip movement fashion the control speed as a whole is decreased correspondingly, thus preventing any excessive supply of the additional air and thereby maintaining the control range of air-fuel ratio small to ensure rapid adjustment of the air-fuel ratio of mixture to the preset air-fuel ratio.

The present invention is not intended to be limited to the above-described embodiment. For example, while the invention has been described as embodied in an additional air control device for adjusting the air-fuel ratio of the mixture produced in a carburetor, the control device can be adapted for compensating the rate of flow of the air in mechanically controlled fuel injection systems.

Further, in addition to the control of the air flow in the intake system of the engine, the control device can be adapted for the control of the air flow in the exhaust system, such as, the control of the secondary air flow to the catalyst.

Still further, while, in the above-described embodiment, a pulse motor is used as drive means, any of D.C. and A.C. motors may be used and moreover any mechanical actuator may equally be used in addition to the electrical actuators.

Still further, while an air flow meter is used as delay detecting means, it is possible to use any of other sensors for sensing such delay time factors as the intake manifold vacuum, engine rotational speed, venturi vacuum, throttle position or the like.

What is claimed is:

1. An additional air control device for an internal combustion engine having an intake system and an exhaust system comprising:

a carburetor connected to the intake system of said internal combustion engine and including a main passage and a bypass passage for supplying air-fuel mixture to said engine;

said main passage being provided with a throttle valve for controlling an amount of main air-flow and said bypass passage being provided with a control valve for compensating the air-fuel ratio of said air-fuel mixture by controlling an amount of additional air-flow flowing therethrough;

a drive motor coupled to said control valve for driving the same in order to control the opening degree of said control valve;

gas sensing means mounted in the exhaust system of said engine for sensing the oxygen content of the exhaust gases therein and deriving an electrical gas sensing signal;

intake air flow sensing means mounted in the intake system of said engine for sensing the rate of intake air flow to said engine and thereby producing an electrical intake air flow signal; and electronic control means electrically connected to said gas sensing means, said intake air flow sensing means and said drive motor, said electronic control means being responsive to said gas sensing signal and said intake air flow signal for alternatively driving and stopping said drive motor repeatedly in a selected direction;

said electronic control unit including a comparison circuit for receiving and comparing said gas sensing signal with a preset value to determine whether said gas sensing signal is greater or smaller than said preset value, a timing control circuit for receiving said intake air flow signal to determine the times of running and stopping of said drive motor in such a manner that said stopping time period is inversely proportional to said intake air flow signal and said running time period, and a switching circuit responsive to the signals from said comparison circuit and said timing control circuit for producing drive motor driving signals, whereby the air-fuel ratio of mixture supplied to said engine is maintained substantially constant.

2. An additional air control device for an internal combustion engine having an intake system, an exhaust system and a catalytic converter for purifying exhaust gases comprising:

a carburetor connected to the intake system of said internal combustion engine and including a passage for substantially rich air-fuel mixture, said passage being provided with a throttle valve for controlling an amount of air-flow;

means defining a bypass passage for supplying additional air to the downstream side of said throttle valve;

a control valve mounted in said bypass passage for controlling the amount of additional air flowing therethrough;

drive means coupled to said control valve for driving said control valve to open and close;

gas sensing means mounted in the exhaust system of said engine upstream of said catalytic converter for producing a gas sensing signal corresponding to the composition of exhaust gases flowing through said exhaust system;

delay time factor detecting means for detecting a delay time factor corresponding to a delay time between the occurrence of a change in the air-fuel ratio of mixture supplied into said intake system and the detection by said gas sensing means of said change as a change in the composition of exhaust gases flowing into the exhaust system and thereby producing an electrical detection signal; and a control unit operatively connected to said gas sensing means, said delay time factor detecting means and said drive means, said control unit receiving said gas sensing signal to thereby determine the direction of operation of said drive means and alternately driving and stopping operation of said drive means and alternately driving and stopping said drive means intermittently, said control unit receiving the detection signal from said delay time factor detecting means to thereby control one of the running time and the stopping time of said drive means and fix the other, whereby the composition of exhaust gases flowing into said catalytic converter is properly adjusted.

3. An additional air control device for an internal combustion engine having an intake system and an exhaust system comprising:

air-fuel mixture supply means provided in the intake system of said internal combustion engine;

an air pipe disposed to supply additional air to said engine;

a bypass valve mounted on said air pipe to control the amount of additional air flowing therethrough;

drive means coupled to said bypass valve for driving said bypass valve to open and close;

gas sensing means mounted in the exhaust system of said engine for producing a signal corresponding to the composition of exhaust gases flowing through said exhaust system;

delay time factor detecting means for detecting a delay time factor corresponding to a delay time between the occurrence of a change in the air-fuel ratio of mixture supplied into said intake system and the detection by said gas sensing means of said change as a change in the composition of exhaust gases supplied into said exhaust system and producing an electrical detection signal; and a control unit operatively connected to said gas sensing means, said delay time factor detecting means and said drive means;

said control unit being responsive to the signal from said gas sensing means to operate said drive means in selected one of the bypass valve opening and closing directions thereof, said control unit driving said drive means in a skip movement fashion for a predetermined period of time and then stopping said drive means in response to the detection signal from said delay time factor detecting means for another period of time which is substantially inversely proportional to said delay time factor, said running and stopping of said drive means being alternately effected repeatedly.

4. A device according to claim 2 further comprising a valve-fully-closed switch connected to said bypass valve for detecting and producing a full closed position signal when said bypass valve has been brought into a fully closed position, said valve-fully-closed switch being electrically connected to said control unit whereby when said bypass valve is in said fully closed position, said control unit prevents said drive means from driving said bypass valve further in the valve closing direction thereof.

5. An additional air control device according to claim 1, wherein said timing control circuit in said control unit comprises a first and a second monostable circuit coupled to each other for generating a pulse signal, and said intake air flow signal representing the amount of intake air flow from said intake air flow sensing means is connected to said second monostable circuit to control the operation thereof, thereby to produce a pulse signal from said timing control circuit, the pulse width ($\tau_a$) thereof being changed dependent on the amount of intake air flow.

* * * * *